United States Patent [19]

Sakurai

[11] Patent Number: 4,674,384

[45] Date of Patent: Jun. 23, 1987

[54] ELECTRONIC MUSICAL INSTRUMENT WITH AUTOMATIC ACCOMPANIMENT UNIT

[75] Inventor: Keiichi Sakurai, Tokyo, Japan

[73] Assignee: Casio Computer Co., Ltd., Tokyo, Japan

[21] Appl. No.: 709,774

[22] Filed: Mar. 8, 1985

[30] Foreign Application Priority Data

Mar. 15, 1984 [JP] Japan ..... 59-48081
May 8, 1984 [JP] Japan ..... 59-90151
Jun. 9, 1984 [JP] Japan ..... 59-118844

[51] Int. Cl.[4] ..... G10H 1/42
[52] U.S. Cl. ..... 84/1.03; 84/DIG. 12
[58] Field of Search ..... 84/1.03, DIG. 12, DIG. 22

[56] References Cited

U.S. PATENT DOCUMENTS 4,044,642 8/1977 Pearlman et al. ..... 84/1.1
4,171,658 10/1974 Aoki et al. ..... 84/DIG. 22
4,402,244 9/1983 Nakada et al. ..... 84/1.03
4,421,001 12/1983 Wilcox et al. ..... 84/1.17
4,481,853 11/1984 Ishikawa ..... 84/DIG. 12
4,503,745 3/1985 Clark, Jr. et al. ..... 84/DIG. 7
4,561,338 12/1985 Ohno ..... 84/DIG. 12

FOREIGN PATENT DOCUMENTS 044945 6/1981 European Pat. Off. .
2728513 1/1978 Fed. Rep. of Germany .
3321876 1/1984 Fed. Rep. of Germany .
2158985 5/1975 United Kingdom .
2156136A 3/1985 United Kingdom .

*Primary Examiner*—Stanley J. Witkowski
*Assistant Examiner*—David S. Warren
*Attorney, Agent, or Firm*—Frishauf, Holtz, Goodman & Woodward

[57] ABSTRACT

Key operation speed of a performance key in the keyboard is detected at speed detector to produce a speed detection signal which is supplied to overspeed detector. When the speed detection signal represents that the key operation speed is higher than a reference value preset in the overspeed detector, an address signal is supplied to a rhythm pattern memory to change a designation address thereof, thereby reading out different rhythm pattern data from the memory.

13 Claims, 17 Drawing Figures

FIG. 10

| | A | B | | A | B |
|---|---|---|---|---|---|
| X1 | 0.111 | 0.2 | X25 | 0.166 | 0.1 |
| X2 | 0 | 0 | X26 | 0 | 0 |
| X3 | 0 | 0 | X27 | 0 | 0 |
| X4 | 0 | 0 | X28 | 0 | 0 |
| X5 | 0 | 0 | X29 | 0 | 0.1 |
| X6 | 0 | 0 | X30 | 0 | 0 |
| X7 | 0.055 | 0.1 | X31 | 0.111 | 0 |
| X8 | 0 | 0 | X32 | 0 | 0 |
| X9 | 0 | 0 | X33 | 0 | 0.1 |
| X10 | 0 | 0 | X34 | 0 | 0 |
| X11 | 0 | 0 | X35 | 0 | 0 |
| X12 | 0 | 0 | X36 | 0 | 0 |
| X13 | 0.222 | 0.1 | X37 | 0.111 | 0.2 |
| X14 | 0 | 0 | X38 | 0 | 0 |
| X15 | 0 | 0 | X39 | 0 | 0 |
| X16 | 0 | 0 | X40 | 0 | 0 |
| X17 | 0 | 0 | X41 | 0 | 0 |
| X18 | 0 | 0 | X42 | 0 | 0 |
| X19 | 0.166 | 0 | X43 | 0.111 | 0 |
| X20 | 0 | 0 | X44 | 0 | 0 |
| X21 | 0 | 0 | X45 | 0 | 0.2 |
| X22 | 0 | 0 | X46 | 0 | 0 |
| X23 | 0 | 0 | X47 | 0 | 0 |
| X24 | 0 | 0 | X48 | 0 | 0 |

FIG. 11

| | | | |
|---|---|---|---|
| a1 | 0.2 | b1 | 0.14 |
| a2 | 0 | b2 | 0 |
| a3 | 0 | b3 | 0 |
| a4 | 0 | b4 | 0 |
| a5 | 0 | b5 | 0.07 |
| a6 | 0 | b6 | 0 |
| a7 | 0.1 | b7 | 0 |
| a8 | 0 | b8 | 0 |
| a9 | 0 | b9 | 0.07 |
| a10 | 0 | b10 | 0 |
| a11 | 0 | b11 | 0 |
| a12 | 0 | b12 | 0 |
| a13 | 0.1 | b13 | 0.07 |
| a14 | 0 | b14 | 0 |
| a15 | 0 | b15 | 0 |
| a16 | 0 | b16 | 0 |
| a17 | 0 | b17 | 0.07 |
| a18 | 0 | b18 | 0 |
| a19 | 0.1 | b19 | 0 |
| a20 | 0 | b20 | 0 |
| a21 | 0 | b21 | 0.07 |
| a22 | 0 | b22 | 0 |
| a23 | 0 | b23 | 0 |
| a24 | 0 | b24 | 0 |
| a25 | 0.2 | b25 | 0.14 |
| a26 | 0 | b26 | 0 |
| a27 | 0 | b27 | 0 |
| a28 | 0 | b28 | 0 |
| a29 | 0 | b29 | 0.07 |
| a30 | 0 | b30 | 0 |
| a31 | 0.1 | b31 | 0 |
| a32 | 0 | b32 | 0 |
| a33 | 0 | b33 | 0.07 |
| a34 | 0 | b34 | 0 |
| a35 | 0 | b35 | 0 |
| a36 | 0 | b36 | 0 |
| a37 | 0.1 | b37 | 0.07 |
| a38 | 0 | b38 | 0 |
| a39 | 0 | b39 | 0 |
| a40 | 0 | b40 | 0 |
| a41 | 0 | b41 | 0.07 |
| a42 | 0 | b42 | 0 |
| a43 | 0.1 | b43 | 0 |
| a44 | 0 | b44 | 0 |
| a45 | 0 | b45 | 0.07 |
| a46 | 0 | b46 | 0 |
| a47 | 0 | b47 | 0 |
| a48 | 0 | b48 | 0 |

ELECTRONIC MUSICAL INSTRUMENT WITH AUTOMATIC ACCOMPANIMENT UNIT

BACKGROUND OF THE INVENTION

This invention relates to an electronic musical instrument, in which a predetermined automatic accompaniment pattern is selected for playing accompaniment according to the state of operation of a performance key on a keyboard.

In a prior art electronic musical instrument with an automatic accompaniment unit, a single rhythm pattern is produced automatically and repeatedly for every two measures or bars as unit period when a predetermined rhythm pattern selection switch is operated.

When a single rhythm pattern is repeatedly produced, however, the performance is rather monotonous and is liable to be soon worn out. Accordingly, it is thought to permit free selection of two variations of rock, for instance of 8-beat and 16-beat, by operating a variation switch.

This concept, however, will increase switches and complicates the circuit construction as well as making the performance operation more difficult.

Further, since a rhythm is automatically produced irrespective of the content of music, the automatic accompaniment will sometimes fail to match the image of the music.

SUMMARY OF THE INVENTION

An object of the invention is to provide an electronic musical instrument, which permits automatic accompaniment of adequate pattern content to be produced according to the state of manual performance of a music.

According to the invention, there is provided an electronic musical instrument comprising:

a keyboard having a plurality of performance keys;

means for producing a detection signal by detecting the state of operation of a performance key;

means for providing a plurality of preset automatic accompaniment pattern data;

means for selectively controlling the generation of automatic accompaniment pattern data according to the detection signal; and means for providing automatic accompaniment according to the controlled automatic accompaniment pattern data.

BRIEF DESCRIPTION OF THE DRAWINGS

FIG. 10 is a view showing an example of a set of data provided from the feature extraction circuit shown in FIG. 7;

FIG. 11 is a view showing preset feature data;

DETAILED DESCRIPTION OF THE PREFERRED EMBODIMENTS

A first embodiment of the invention will now be described with reference to FIGS. 1 to 3.

Figure 1:
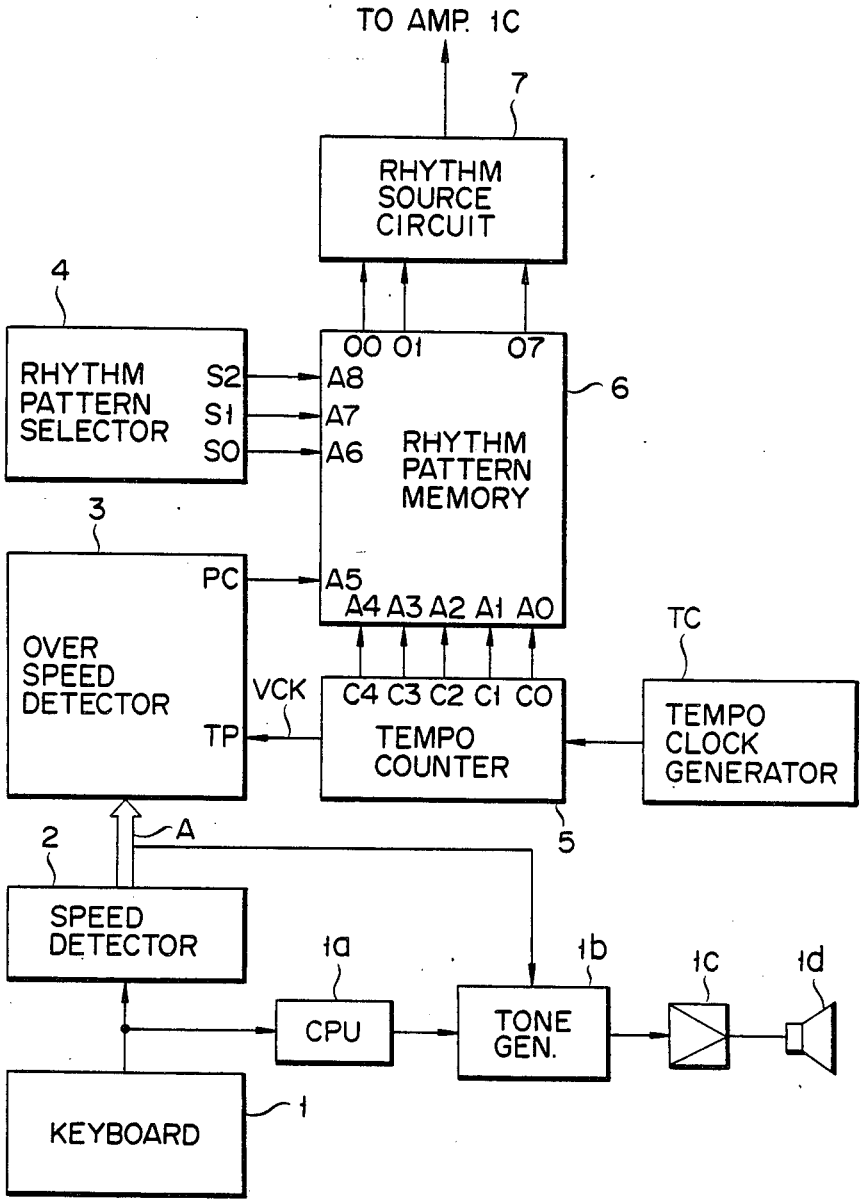
FIG. 1 is a block diagram showing an embodiment of the invention.

Referring to FIG. 1, there is shown the embodiment of the electronic musical instrument with automatic accompaniment unit, which has a keyboard 1 with 61 performance keys for notes C2 to C7. When a performance key is operated a key output is produced and a CPU 1*a* detects the key output to produce key code data. The key code data is fed to a tone generator 1*b*, which then produces a corresponding tone signal. The tone signal thus produced is fed through an amplifier 1*c* to a loudspeaker 1*d* to be sounded. The tone generator 1*b* includes a frequency signal generating circuit for generating a frequency signal corresponding to the note represented by the key code data, a circuit for generating an envelope signal, and a circuit for multiplying the frequency signal and envelope signal to produce the tone signal.

The operation of the performance key is also detected by a speed detector 2. The speed detector 2 produces an output corresponding to the speed, at which the performance key is operated, i.e., an output proportional to the speed, at which the performance key is depressed from the stationary position. For example, with the depression of the performance key a magnet coupled to a common bar provided below the performance keys is moved through a coil, whereby an electric output corresponding to a change in the impedance of the coil is obtained.

In an actual arrangement, a pressure detector may be provided on a stopper, against which the performance key is depressed, and which thus provides an output corresponding to the pressure exerted by the depressed performance key, and an OR output of the outputs of the speed detector 2 and pressure detector may be used in lieu of the output of the speed detector as a key depression detection output.

The output of the speed detector 2 is also fed to an overspeed detector 3.

The overspeed detector 3 judges whether the input key depression speed data is greater or less than a predetermined value, and it feeds a detection signal PC from its output terminal PC to an address input terminal A5 of a rhythm pattern memory 6. The overspeed detector 3 also counts a carry signal supplied as a measure clock VCK from a tempo counter 5 to its input terminal TP. When it has counted the measure clock VCK for a predetermined period (i.e., for two measures in this embodiment), it ceases to provide the detection signal PC.

The tempo counter 5 counts a tempo clock provided from a tempo clock generator TC, and its count output is fed from its output terminals C4 to C0 to address input terminals A4 to A0 of the rhythm pattern memory 6. In the rhythm pattern memory 6 are preset a plurality of rhythm pattern data, and an output of a rhythm pattern selector 4 for selecting a rhythm, e.g., rock and waltz, is supplied to address input terminals A6, A7 and A8 of the rhythm pattern memory 6. Thus, every time a tempo clock pulse is produced, rhythm pattern data corresponding to the input signal fed to the address input terminals A8 to A6 of the rhythm pattern memory 6 is read out from output terminals 07 to 00 thereof and fed to a rhythm source circuit 7. The rhythm source circuit 7 includes eight different rhythm sources, e.g., bass drum, cymbals, etc., and it provides a rhythm source signal by being driven by corresponding bit data of the rhythm pattern data. The rhythm source signal thus provided is fed through the amplifier 1*c* and loudspeaker 1*d* to be sounded as an automatic accompaniment rhythm sound.

Figure 2:
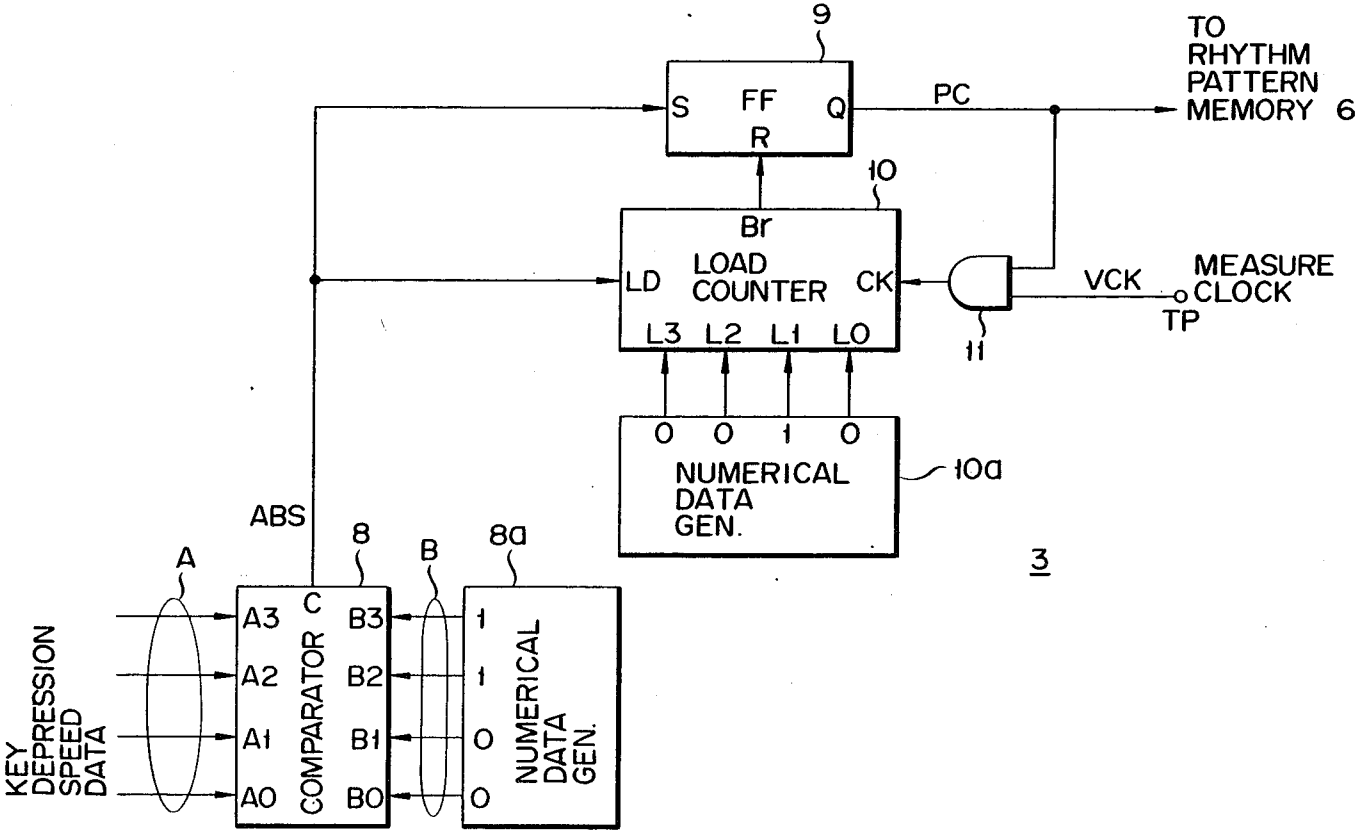
FIG. 2 is a block diagram showing an overspeed detector shown in FIG. 1.
Figure 3:
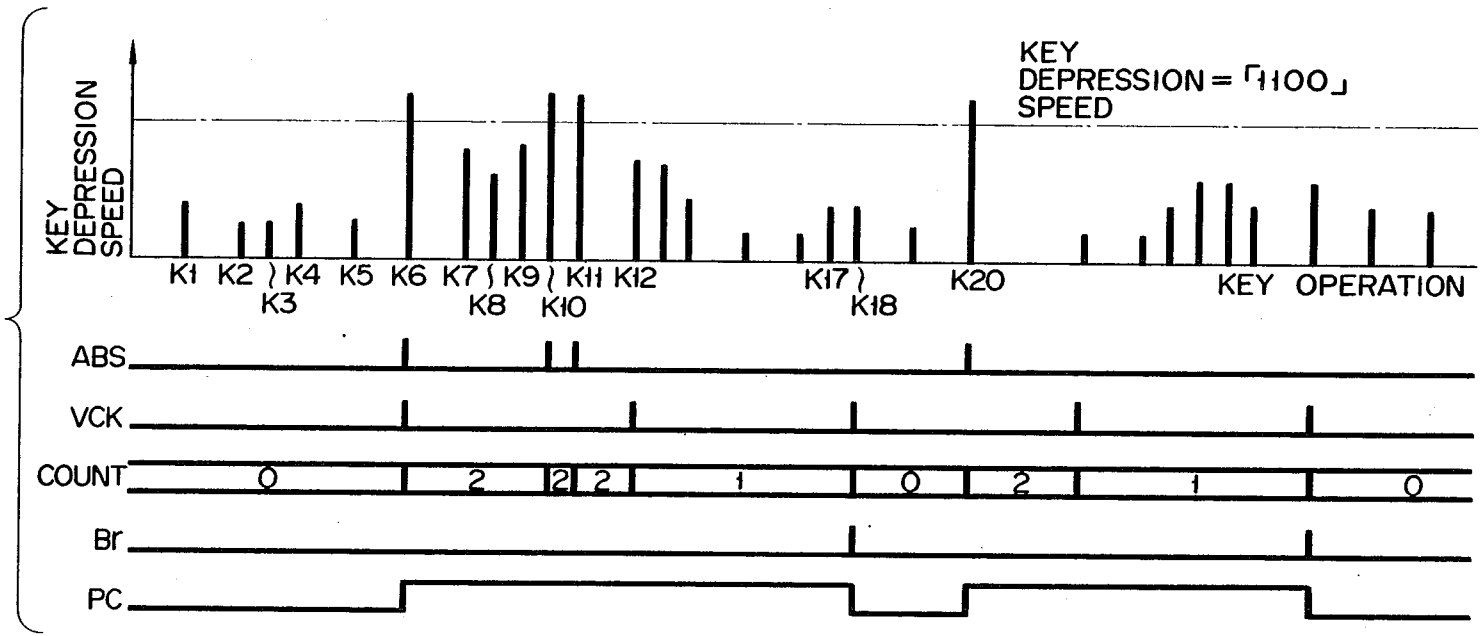
FIG. 3 is a chart for explaining the operation of the overspeed detector shown in FIG. 2.

FIG. 2 shows a specific circuit construction of the overspeed detector 3. The key depression speed data from the speed detector 2 is fed as 4-bit data A to input terminals A3 to A0 of a comparator 8. Preset key depression speed data from a numerical data generator 8*a*, which is 4-bit data B representing a preset value "1100", is supplied to input terminals B3 to B0 of the comparator 8. The comparator 8 compares the data at both the input terminal sets A3 to A0 and B3 to B0 and feeds the result signal ABS (which is "1" when $A \geqq B$) to a set terminal S of an SR flip-flop 9 and also to an input terminal LD of a load counter 10.

The output from the set output terminal Q of the flip-flop 9 is fed as the detection signal PC to the rhythm pattern memory 6, and is also fed as a gate control signal to an AND gate 11. To the AND gate 11 is also fed the measure clock VCK from the tempo counter 5. The output of the AND gate 11 is fed to a clock input terminal CK of the load counter 10. To an input terminal set L3 to L0 of the load counter 10 is supplied preset measure data "0010" representing two measures from the numerical value generator 10*a*. The load counter 10 fetches the data "0010" when the result data ABS is "1", and then it down-counts the measure clock VCK. When its count becomes "0000", the load counter 10 feeds a "1" signal from its output terminal Br to a reset terminal R of the flip-flop 9.

The operation of the first embodiment having the above construction will now be described with reference to the time chart of FIG. 3. Before the start of the automatic accompaniment rhythm performance, a desired rhythm, e.g., rock, is designated by operating a rhythm selection lever (not shown) coupled to the rhythm pattern selector 4. By so doing, the designation data is generated from the rhythm pattern selector 4 and fed to the address input terminal set A8 to A6 of the rhythm pattern memory 6.

Then, the tempo clock generator TC is rendered operative by turning on a rhythm start switch (not shown). In this state, the key operation on the keyboard 1 is started simultaneously with the start of rhythm generation. With the rhythm start, the tempo clock starts to be provided from the tempo clock generator TC to be fed to and counted by the tempo counter 5. The count output of the tempo counter 5 is fed to the address input terminal set A4 to A0 of the rhythm pattern memory 6. When no performance key is operated or when the operation speed of a key is below a preset speed, detection signal PC of "0" is fed to the address input terminal A5. Consequently, normal rhythm pattern data designated by the rhythm selector 4 is repeatedly read out from the rhythm pattern memory 6 for each measure. This data is coupled from the output terminal set 07 to 00 to the rhythm source circuit 7 to drive a rock rhythm source, for instance. Rock rhythm thus is sounded from the loudspeaker 1*d*.

When a performance key on the keyboard 1 is operated for melody play, the corresponding tone is sounded from the loudspeaker 1*d*, while at the same time the depression speed of the key is detected by the speed detector 2. The detected key depression speed data is fed as digital data A from the speed detector 2 to the input terminal set A3 to A0 of the comparator 8 in the overspeed detector 3 to be compared to the preset numerical data B of "1100" at the input terminal set B3 to B0. When the key depression speed data is less than the preset data "1100" as in the case of the depression of the first to fifth keys K1 to K5 shown in FIG. 3, the result signal ABS provided at the time of the key depression is "0" for $A<B$. In this case, the flip-flop 9 is not set, i.e., it is held reset. Also, the load counter 10 does not start counting operation.

When the key depression speed data is greater than the preset data "1100", for instance "1101", as in the case of the depression of the sixth key K6, a "1" signal is provided as the result signal ABS for $A>B$. As a result, the flip-flop 9 is set, and the load counter 10 fetches the preset measure data "0010" from the numerical value generator 10*a*. The flip-flop 9 thus provides a set output (i.e., detection signal PC) of "1" to the address input terminal A5 of the rhythm pattern memory 6, and also the AND gate 11 is enabled. Thus, fill-in rhythm pattern data is read out in lieu of the normal rhythm pattern data from the rhythm pattern memory 6 until the initial count "0010" of the load counter 10 is down-counted to "0000" to invert the signal PC to "0" and reset the flip-flop 9, i.e., for the period of two measures, the fill-in rhythm being sounded as automatic accompaniment rhythm from the loudspeaker 1*d* for this period.

When the key depression speed of the subsequently operated key is less than the preset numerical value such as the case of the seventh to nineth keys K7 to K9, the result signal ABS is "0", so that the flip-flop 9 remains set, and also the preset measure data "0010" (which corresponds to decimal "2") remains set in the load counter 10. When the key depression speed of the operated key is greater than the preset speed as in the case of the tenth and eleventh keys K10 and K11, a "1" signal is provided as the result signal ABS, but the state of the flip-flop 9 and load counter 10 remains unchanged. The key depression speed of the twelfth key K12, which is operated at the end of the first measure, is less than the preset speed, so that the result signal ABS is provided as "0" signal. Also, a pulse of the measure clock VCK is provided from the tempo counter 5 and is fed to the clock input terminal CK of the load counter 10 for down-counting, so that the count of the load counter 10 becomes "1" (i.e., "0001").

The key depression speeds of the twelfth to seventeenth keys K12 to K17, which are operated until the next pulse of the measure clock VCK appears, are all less than the preset value "1100". However, even if a key is depressed at a greater speed value than "1100" during this time, the flip-flop 9 will remain in the set state, and also the count output of the load counter 10 remains at "1" (i.e., "0001"). The key depression speed of the eighteenth key K18, which is depressed at the appearance of the second pulse of the measure clock VCK, is smaller than the preset value, so that the count output of the load counter 10 is further reduced by downcounting to "0". As a result, the signal Br becomes "1" to reset the flip-flop 9. Also, a "0" signal is fed as the signal CP to the address input terminal A5 of the rhythm pattern memory 6 and AND gate 11. Thus, the reading of the fill-in rhythm pattern data which has been continued for the period of two measures, changed to the reading of the normal rhythm pattern data, so that the automatic accompaniment of the normal rhythm is resumed. Further, the AND gate 11 is disabled to inhibit the down-counting operation of the load counter 10.

The twentieth key K20 is depressed before the next pulse of the measure clock VCK appears. The key depression speed at this time is above the preset speed, so that the signal ABS is provided as a "1" signal. As a result, the flip-flop 9 is set to invert the signal PC to "1", and the load counter 10 fetches again the preset measure data of "2". In this way, normal automatic accompaniment rhythm is switched over to the fill-in rhythm at an intermediate instant in the measure, and this fill-in rhythm is continued until two pulses of the measure clock VCK are subsequently provided.

Figure 4:
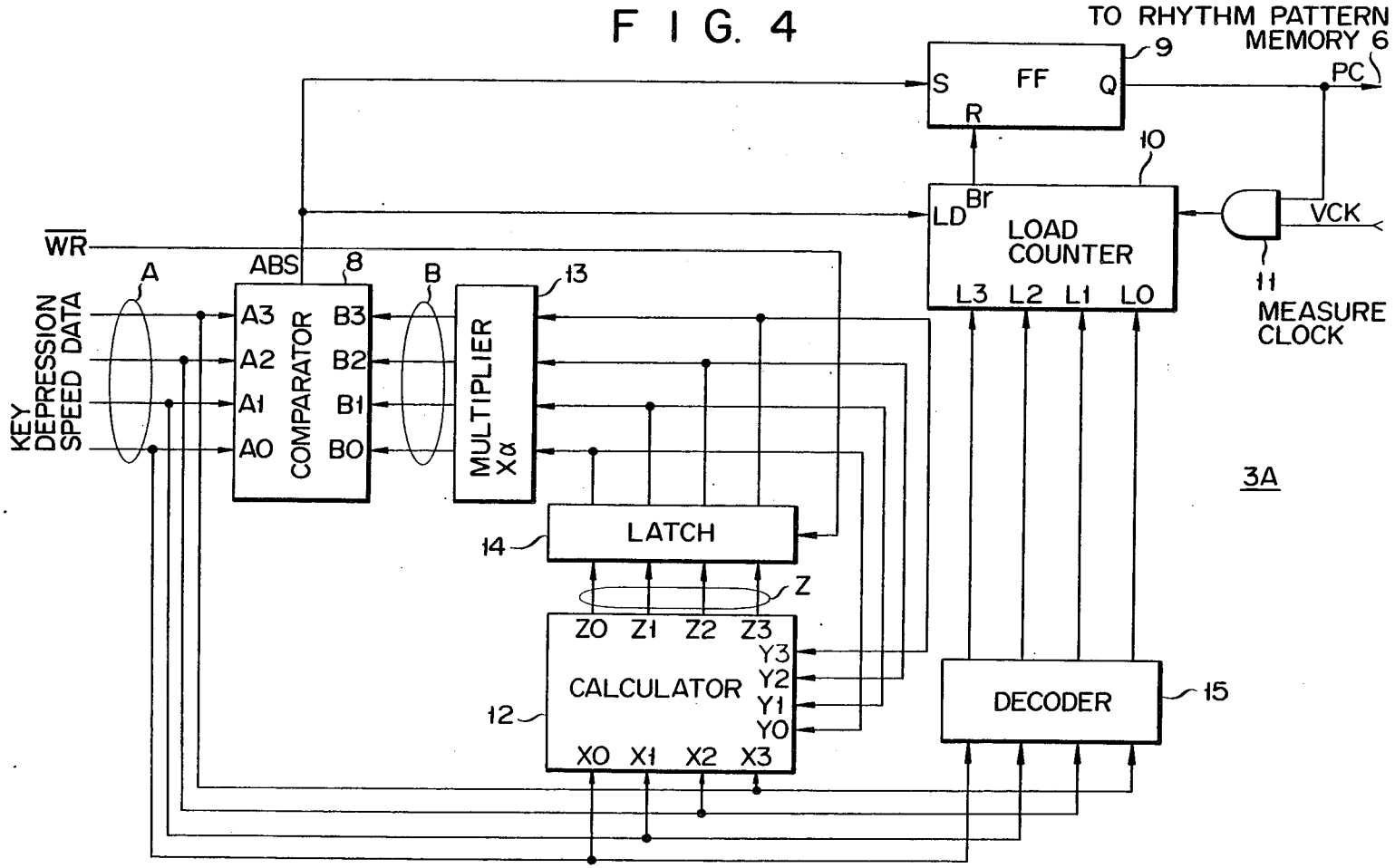
FIG. 4 is a block diagram showing an overspeed detector in a different embodiment of the invention.
Figure 5:
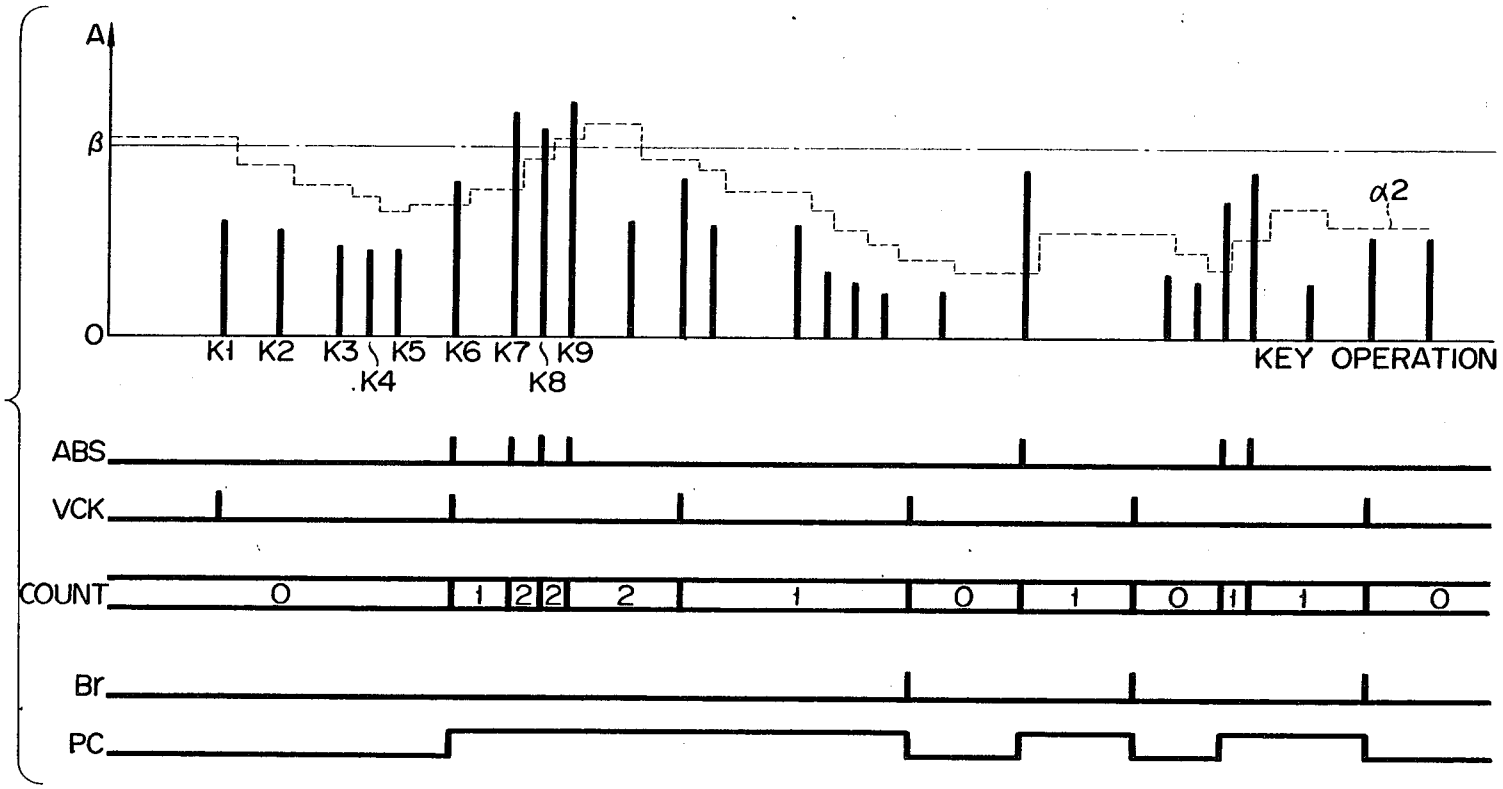
FIG. 5 is a chart for explaining the operation of the circuit shown in FIG. 4.

A second embodiment of the invention will now be described with reference to FIGS. 4 and 5. In this embodiment, two different values are provided as the preset value, to which the key depression speed value A is compared, i.e., one being varied according to the prevailing key depression speed value A and the other being an absolutely fixed value. The duration of the fill-in rhythm is changed according to the two different preset values. FIG. 4 shows a specific circuit construction of only overspeed detector 3 in the second embodiment. The rest of the embodiment is the same as the preceding first embodiment, so parts like those in the first embodiment are designated by like reference numerals, and their description is omitted.

Referring to FIG. 4, the key depression speed data A is fed to an input terminal set X0 to X3 of a calculator 12. Data from latch 14 is fed back to an input terminal set Y0 to Y3 of the calculator 12. The calculator 12 performs a calculation on $$Z=0.1A+0.9Y$$

where A and Y respectively represent the input signals to the input terminal sets X0 to X3 and Y0 to Y3, and it provides the results Z of calculation as output.

The result Z of calculation is the average value between the prevailing key depression speed value A and previous value Y accumulated in the latch 14, and it is provided from an output terminal set Z0 to Z3 as a new average value to the latch 14. The latch 14 latches the result data Z under the control of a latch signal $\overline{WR}$="1" which is provided from a CPU (corresponding to the CPU 1*a* in FIG. 1) at the time of the key depression. The latched result data Z is fed to the input terminal set Y0 to Y3 and also to a multiplier 13. The multiplier 13 multiplies the result data Z by $\alpha$ and feeds the product $\alpha Z$ as data B to the input terminal set B0 to B3 of comparator 8 for comparison to the prevailing key depression speed data A. The key depression speed data A is further fed to a decoder 15. The output of the decoder 15 is fed to the input terminal set L0 to L3 of load counter 3. The decoder output is "2" when the data A is greater than a preset value $\beta$, "1" when the data A is intermediate between $\beta$ and $\alpha Z$ (as shown by a dashed plot in FIG. 5) and "0" when the data A is less than $\alpha Z$. When the decoder output is "2", it designates two measures as the longest rhythm pattern alternation period, while when it is "1" it designates one measure as the period noted.

The operation of this embodiment will now be described with reference to FIG. 5. Whenever a performance key is depressed, the corresponding key depression speed data A is fed to the input terminal set A0 to A3 of the comparator 8, input terminal set X0 to X3 of the calculator 12 and decoder 15. The previous calculation result Z is fed back from the latch 14 to the input terminal set Y0 to Y3 of the calculator 12, and the calculator 12 performs the calculation on the equation noted above. When the prevailing key depression speed data A is less than the previous one as in the case of the depression of the second to fourth keys K2 to K4, the result Z of calculation is less than the previous one, $\alpha$ times the result being fed to the input terminal set B0 to B3 of the comparator 8. When the prevailing key depression speed data A is less than the data B, which is $\alpha$ times the previous result Z as in the case of the depression of the first to fourth keys K1 to K4, the signal ABS is "0", and the flip-flop 9 remains reset. Also, the load counter 10 does not fetch the output of the decoder 15, i.e., "1", at the time of the depression of the first to fourth keys K1 to K4 for in these cases the key depression speed data A is less than $\alpha Z$.

When the prevailing key depression speed data is less than the previous one as in the case of the depression of the fifth key K5, the result Z is naturally reduced. When the key depression speed data A exceeds the product $\alpha Z$ as in the case of the depression of the sixth key K6, the comparator 8 provides a "1" signal as the signal ABS to set the flip-flop 9. Also, since the key depression speed of the sixth key K6 is less than $\beta$, the decoder 15 provides data "1" (i.e., "0001") to be set in the load counter 10. As a result, the automatic accompaniment rhythm is switched to the fill-in rhythm from this instant in the manner as described before in connection with FIGS. 1 to 3.

When the key depression speed data A exceeds $\beta$ as in the case of the depression of the seventh key K7, the signal ABS is provided as a "1" signal, and the decoder 15 at this time provides data "2" which is set in the load counter 10. Thus, the fill-in rhythm period is extended. At the times of the depression of the eighth and nineth keys K8 and K9, at which time the value of the key depression speed data A is above $\beta$ and the previous value, the signal ABS is provided as "1" signal, and data "2" (i.e., "0010" is set afresh in the load counter 10. Subsequently, the load counter 10 downcounts every pulse of the measure clock VCK, so that its count is changed from "2" to "1" and then to "0". When the count becomes "0", the fill-in rhythm is switched again over to the normal rhythm. In the above way, the fill-in rhythm period is switched between two-measure and one-measure periods depending on the prevailing state of performance. Thus, the switching between the normal rhythm and fill-in rhythm is effected in an optimum way in accordance with the state of performance.

While in the above embodiment the key depression speed has been detected for the rhythm pattern control, it is also possible to detect to this end the key depression pressure using a pressure detector in lieu of the speed detector 2.

As has been shown, in this embodiment the rhythm pattern control is effected according to the key depression speed or key depression pressure. Thus, the rhythm pattern can be changed very naturally according to the state of performance of music, so that it is possible to obtain a very satisfactory automatic accompaniment rhythm.

FIGS. 6 to 11 illustrate a further embodiment. In this embodiment, data indicative of the feature of key operation is extracted according to a key depression timing in a preset period or key depression speed signal, and one of a plurality of preset automatic accompaniment patterns is selected using the feature data thus obtained, whereby the best automatic accompaniment pattern is automatically selected with the progress of manual performance of melody.

Figure 6:
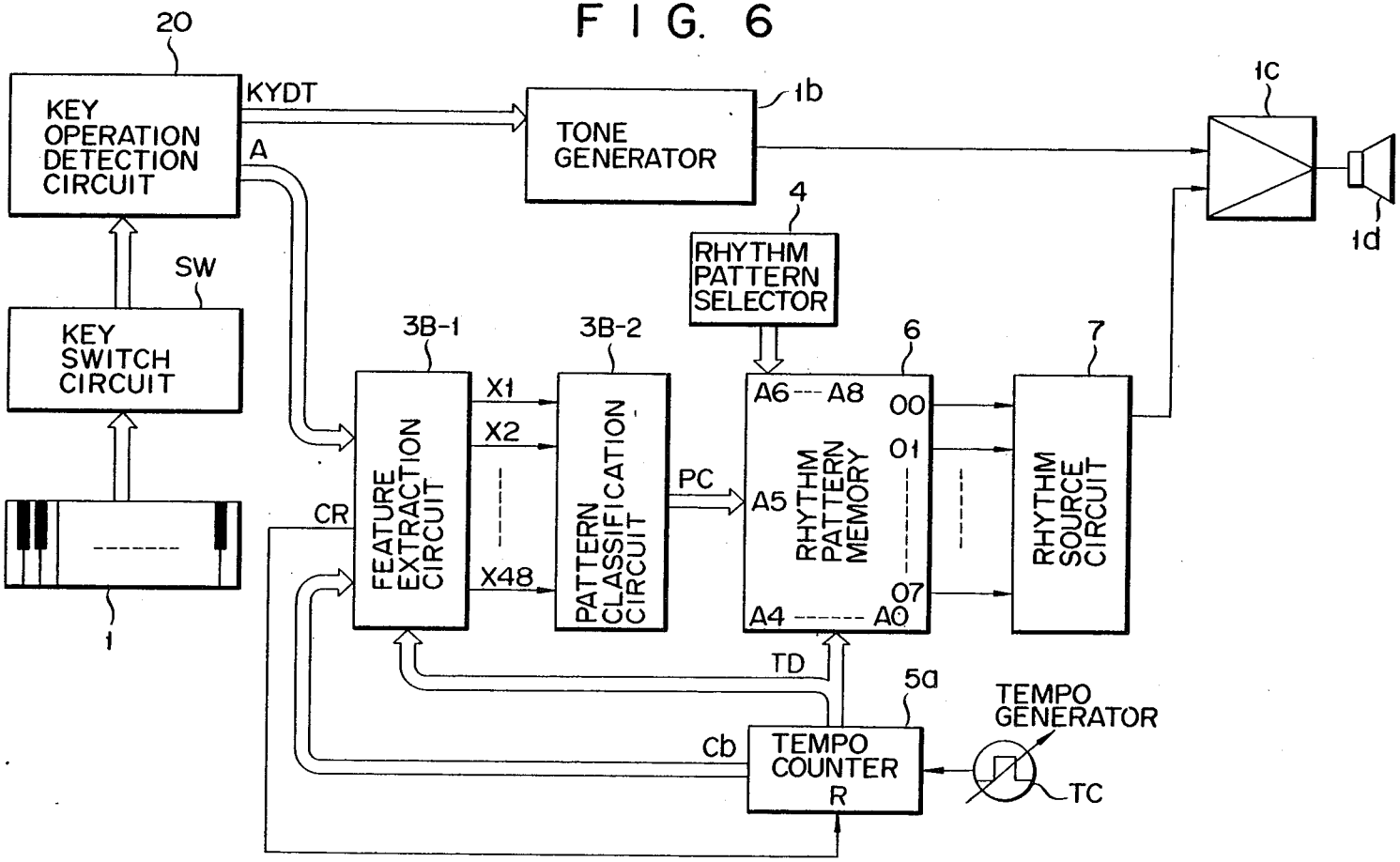
FIG. 6 is a block diagram showing a further embodiment of the invention.

In FIG. 6, parts like those in FIG. 1 are designated by like reference numerals, and their description is omitted. A key operation detection circuit 20 includes the CPU 1*a* and speed detector 2 shown in FIG. 1. The circuit 20 produces key code data KYDT and key depression speed data A in response to the operation of a performance key on keyboard 1. The key code data KYDT is fed to a tone generator 1*b*, while the key depression speed data A is fed to the tone generator 1*b* and also to a feature extraction circuit 3B-1.

A tempo clock corresponding to a preset tempo is generated from a tempo clock generator TC to be counted by a tempo clock counter 5*a*. The tempo counter 5*a* produces timing data TD representing 48 timings dividing one measure. It also produces measure data Cb capable of cyclically assuming values "0" to "3" respectively representing a period of one to four measures. The timing data TD is fed to the feature extraction circuit 3B-1 and rhythm pattern memory 6, and the measure data Cb is fed to the feature extraction circuit 3B-1.

When a power switch is turned on or when a rhythm start/stop switch (not shown) is turned on and off, the feature extraction circuit 3B-1 produces a signal CR to reset the tempo counter 5*a*. The feature extraction circuit 3B-1 also feeds data x1 to x48 to a pattern classification circuit 3B-2. The data x1 to x48 represents the result of division of the number of key depressions at like timing among the 48 timings in each measure by the total number of key depressions in four measures as one cycle. This will be described later in detail.

Figure 9A:
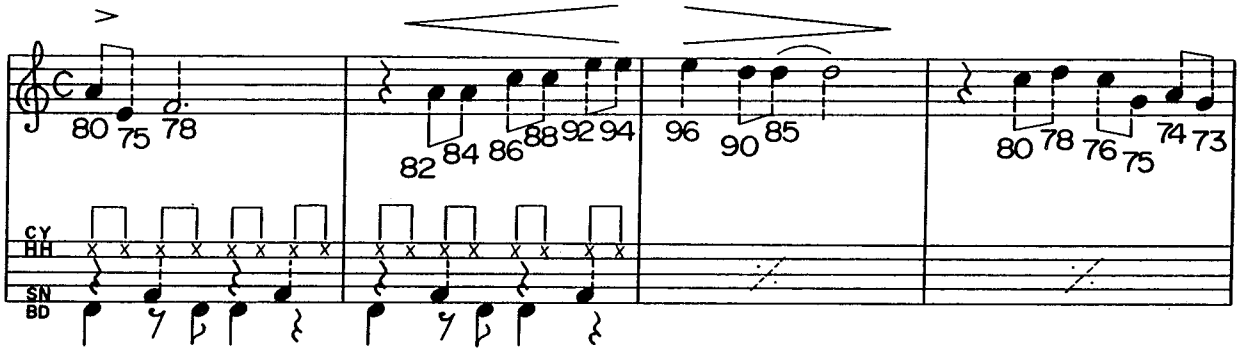
FIGS. 9A and 9B are music scores showing different melodies and rhythm patterns.
Figure 9B:
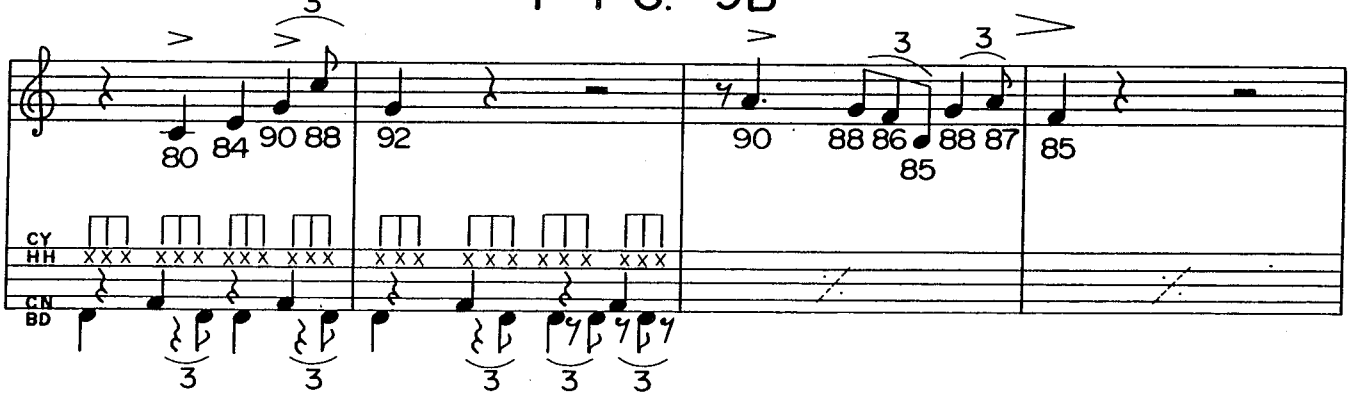

In the pattern classification circuit 3B-2 are stored key operation feature data a1 to a48 and b1 to b48 of two different melodies shown in FIGS. 9A and 9B. The pattern classification circuit 3B-2 judges the prevailing key operation state according to the data x1 to x48, and judges that the judged state more resembles one of the two different patterns. According to the result of judgement, it feeds a pattern selection signal PC designating the rhythm pattern of either rock or rock ballade to the address input terminal A5 of the rhythm pattern memory 6.

In other words, the feature data a1 to a48 and b1 to b48 represent features of the melodies of melody corresponding to the rock rhythm shown in FIG. 9A or rock ballade rhythm shown in FIG. 9B, i.e., features of the key depression states for each melody. For example, data obtained through statistical processing of data x1 to x48 which are actually obtained by performing the melody suited to the rock rhythm, are preset as the feature data a1 to a48 in the pattern classification circuit 3B-2. The pattern classification circuit 3B-2 performs calculations on equations $$da = (x1 - a1)^2 + (x2 - a2)^2 + \ldots + (x48 - a48)^2 \quad (1)$$

and $$db = (x1 - b1)^2 + (x2 - b2)^2 + \ldots + (x48 - b48)^2 \quad (2)$$

for the individual patterns from the feature data a1 to a48 and b1 to b48 and data x1 to x48. Of these data da and db (which represent distances) thus obtained, the one having a smaller value (representing a small distance) is determined to be more resembling, and a corresponding pattern selection signal PC designating either rock or rock ballade is generated. The method of calculation is the same as the similarity calculation in the usual pattern recognition.

In the rhythm pattern memory 6 are stored rhythm pattern data of a number of rhythms including rock and rock ballade as noted above and also other rhythms that are selectable by the rhythm pattern selector 4.

Figure 7:
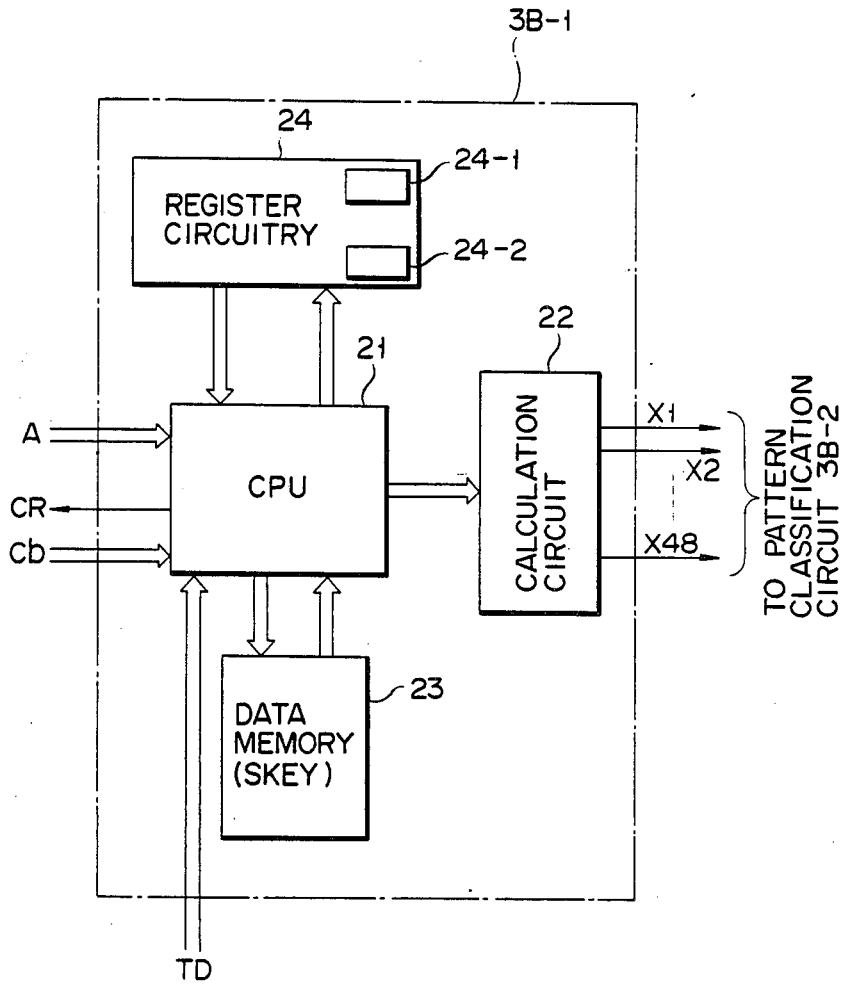
FIG. 7 is a block diagram showing a feature extraction circuit shown in FIG. 6.

FIG. 7 shows a specific circuit construction of the feature extraction circuit 3B-1. In a CPU 21 is stored a control program for causing a calculator 22 to calculate and provide feature data x1 to x48 for every four measures according to the key depression speed data A, measure data Cb and timing data TD. A data memory 23 includes 48 counters SKEY for respective 48 timings in one measure and which are incremented by +1 when there is a key depression at the corresponding timing. A register circuit 24 includes a counter 24-1 for successively designating the individual timings and a counter 24-2 for counting the total key depression number in four measures. The CPU 21 further produces a reset signal CR in such case as when the power switch is turned on.

The operation of this embodiment will now be described with reference to FIGS. 8 to 11. To simplify the description, it is assumed that in this embodiment the two different rhythms, i.e., the rock rhythm shown in FIG. 9A and the rock ballade shown in FIG. 9B, are automatically switched according to the content of melody performance to be provided as automatic accompaniment. The feature data a1 to a48 and b1 to b48 specifically have contents as shown in FIG. 11 for the respective melodies of FIGS. 9A and 9B, which are preset in the pattern classification circuit 3B-2.

It is now assumed that the melody shown in FIG. 9A is manually performed on the keyboard 1. The rhythm pattern selector 4 is set to designate the rhythm of rock.

When the performance is started, the key operation detection circuit 20 produce the key code data KYDT and key depression speed data A for each key operation output. The key code data KYDT is fed to the tone generator 1*b* to produce the corresponding tone signal, which is fed through the amplifier 1*c* and loud-speaker 1*d* to be sounded. The key depression speed data A is fed to the feature extraction circuit 3B-1. The feature extraction circuit 3B-1 produces, from the timing data TD and measure data Cb from the tempo counter 5*a*, the data x1 to x48 indicative of the features of the melody of FIG. 9A (which are of the contents as shown in FIG. 10 to be described later) which are fed to the pattern classification circuit 3B-2 for every four measures.

The pattern classification circuit 3B-2 performs the calculations on the equations 1 and 2 using the input data x1 to x43 and internally preset data (i.e., feature data) a1 to a48 and b1 to b48. In this case da<db is detected, so that it feeds a pattern selection signal PC designating the rhythm of rock to the rhythm pattern memory 6. Rhythm pattern data of rock is thus continuously read out from the memory 6 and fed to the rhythm source circuit 7, whereby automatic accompaniment rhythm of rock is produced to accompany the melody sound of manual performance on the keyboard 1.

Figure 8:
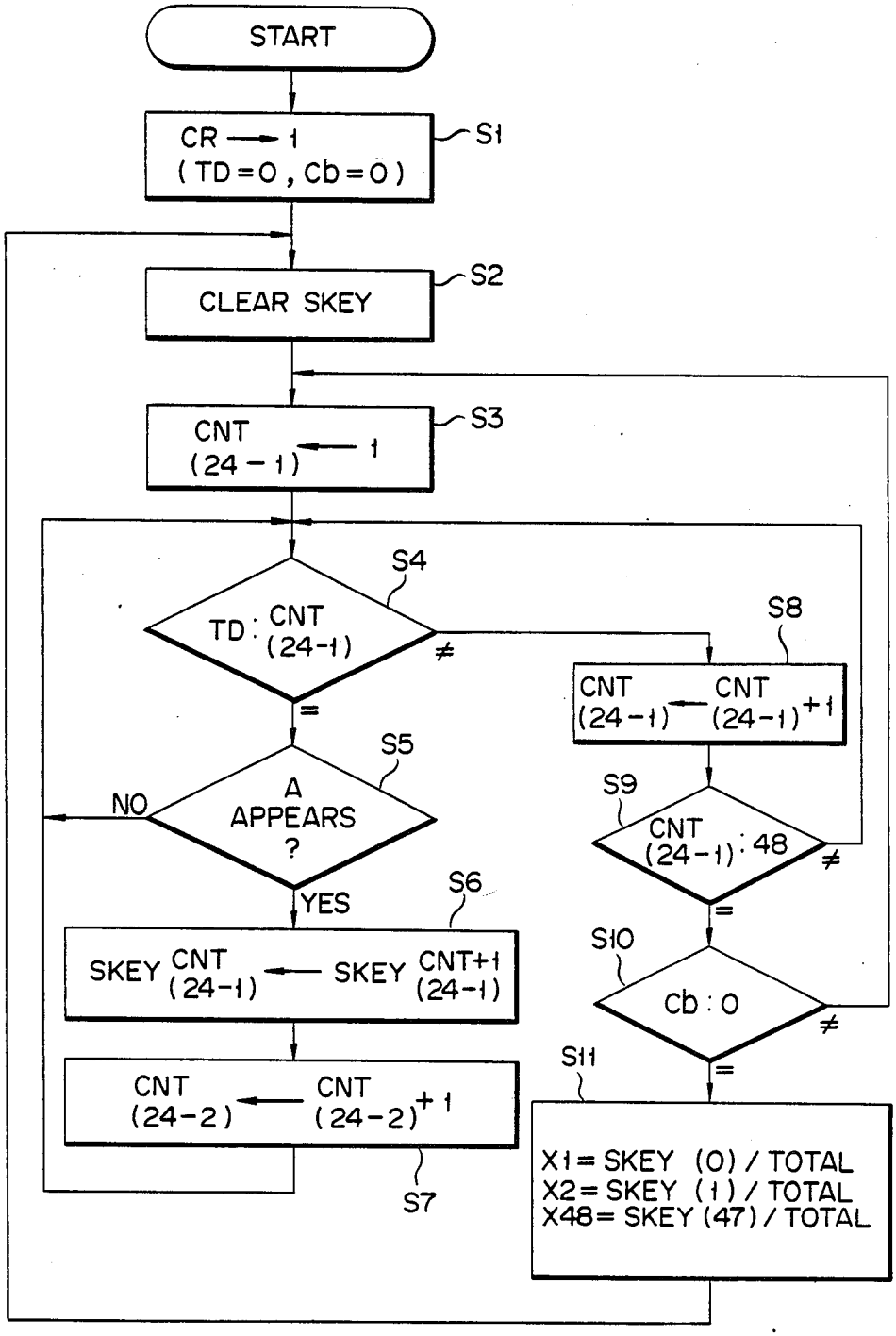
FIG. 8 is a flow chart for explaining the operation of the circuit of FIGS. 6 and 7.

The operation of the feature extraction circuit 3B-1 will now be specifically described with reference to the flow chart of FIG. 8. This flow chart illustrates a routine of calculating the data x1 to x48 with four measures as a unit for the reason noted above.

When the first measure of the melody is started, a step S1 is executed, in which the CPU 21 in the feature extraction circuit 3B-1 produces as the signal CR a "1" signal to reset the tempo counter 5*a*. Thus, both the timing data TD and measure data Cb are "0".

In a subsecuent step S2, the 48 counters SKEY(0) to SKEY(47) for the respective 48 timings, in the data memory 23, are all cleared. In a subsecuent step S3, the counter 24-1 in the register circuit 24 is cleared, whereby the first timing in this measure, i.e., first measure, is set.

In a subsequent step S4, a check is done as to whether the timing data TD and the count of the counter 24-1 coincide. Since the two data coincide at this time, the routine goes to a step S5, in which a check is done as to whether new key depression speed data A is fed to the CPU 21. In the instant case, the steps S5 and S4 are executed repeatedly until the key for the first tone (of note A4) of the melody of FIG. 9A is operated at the start of the performance. When this key is operated, the routine goes to a step S6, in which the count of the counter SKEY(0) for the first timing is incremented by +1 to "1". This takes place because the first tone is to be sounded at a timing corresponding to the first one of the 48 timings in the first measure.

In a subsecuent step S7, the count of the counter 24-2 in the register circuit 24 is incremented by +1 to "1". The count of the counter 24-2 represents the total number of key depressions executed in four measures as a unit. The routine subsecuently goes back to the step S4. When the timing data C0 is subsequently incremented by +1 to "1", representing the second timing, it is detected in the step S4 that the two data do not coincide, so that the routine goes to a step S8, in which the count of the counter 24-1 is incremented to "1" representing the second timing. In a subsequent step S9, a check is done as to whether the count of the counter 24-1 is "48" representing the end of one measure. Since this is not so at this time, the routine goes back to the step S4.

In the step S4 the two data coincide this time, so that the step S5 is executed to check whether there is new key depression speed data. Since the first tone has an interval of an eighth note, it is continues up to the sixth timing. Thus, the next key depression corresponds to the seventh timing. That is, the steps S4, S5, S4, S8, S9, S4, S5, . . . are repeated in this order until the count of the counter 24-1 is "6". During this time, the count of the counter 24-1 is incremented one by one from "1" to "6".

When the count of the counter 24-1 becomes "6" and the key for the second tone (of note E4) is operated, the steps S5, S6 and S7 are executed to increment the counter SKEY(6) for the seventh timing by +1 to "1" and also increment the counter 24-2 by +1 to "2", and then the routine goes back to the step S4. The steps S4, S5, S4, S5, S8, S9, S4, S5, . . . are then repeatedly executed in this order to increment the count of the counter 24-1 one by one up to "12" until the the key for the third tone (of note F4) is operated at the thirteenth timing.

When the thirteenth timing is reached, the counter SKEY(12) for this timing is incremented by +1 to "1" and the counter 24-2 is incremented by +1 to "3" through the steps S4 to S7, and the routine goes back to the step S4. The tone of F4 is thus continued until the start of the second measure. During this time, the count of the counter 24-1 is incremented one by one up to "48" through repeated execution of the steps S3 to S5, S8 and S9. When the count becomes "48", this is detected in the step S9, so that a step S10 is executed, in which a check is done as to whether the measure data Cb is "0". At this instant, the measure data Cb has been incremented by +1 to "1" representing the second measure, so that the routine goes back to the step S3 to clear the counter 24-1.

Subsequent processing for the second to fourth measures of the melody is entirely the same as for the first measure. In each measure, the counters SKEY(0) to SKEY(47) are incremented by +1 for every corresponding timing of key depression. The counter 24-2 is incremented for every key depression and thus counts the total number of key depressions in four measures. When the last, i.e., 47-th, timing in fourth measure is reached, the count of the counter 24-1 becomes "48", so that the step S10 is executed subsequent to the step S9. Immediately before this, the measure data Cb has been cleared to "0" representing the state of the next four measures. Thus, a step S11 is executed subsequent to the step S10. In the step S11, each of the data x1 to x48 for the 1-st to 47-th timings, i.e., each of the counts of the counters SKEY(x) (x being 1 to 48), is divided by the count of the counter 24-2 (which is "19" in the instant case) to obtain result data as shown in column A in FIG. 10, the result data being fed to the pattern classification circuit 3B-2.

The pattern classification circuit 3B-2 thus executes the calculations on the equations 1 and 2 with the input data x1 to x48 shown in FIG. 10 and preset data a1 to a48 and b1 to b48 shown in FIG. 11. In this case, da=0.030 and db=0.093, i.e., da<db. The pattern classification circuit 3B-2 thus feeds a pattern selection signal PC designating the rhythm of rock to the rhythm pattern memory 6. When performing the melody shown in FIG. 9B, we have da=0.117 and db=0.076, i.e., da>db. Consequently, rock ballade is automatically selected as the automatic accompaniment rhythm. The operation concerning FIG. 8 in this case, is the same as described before in connection with the rhythm pattern for the melody of FIG. 9A.

The above description of the operation has been done for the operation from the start of performance of melody so that the automatic accompaniment rhythm, i.e., rock for the melody of FIG. 9A, has been selected in advance by the pattern selector 4. When the music is changed during performance to the melody shown in FIG. 9B, the automatic accompaniment rhythm is automatically changed to rock ballade for this melody through the calculations noted above. Of course by changing the melody of FIG. 9B to the melody of FIG. 9A during performance, the automatic accompaniment rhythm is automatically switched over to rock.

In this embodiment, automatic accompaniment rhythms are switched by judging the key operation state from the key depression timing, it is also possible to judge the key operation state from the key depression speed for the switching of automatic accompaniment rhythms.

Numerals shown under the tones of the melodies in FIGS. 9A and 9B designate relative key depression speed values with "100" being the maximum speed value. The data x1 to x48 may be provided for each of the 48 timings by calculating the average key depression speed for four measures as a unit.

In the above embodiment two different rhythms have been provided for selection, but is of course possible to provide three or more different rhythms for selection.

Further, while in the above embodiment the distance has been calculated as Euclid distance, but it is possible to replace it with Machalanobis distance, moment correlation coefficient, etc.

Further in the above embodiment the pattern classification has been executed in only a single stage of calculation (i.e., calculations on the equations 1 and 2), but it is also possible to arrange a plurality of cascade connection pattern classification stages, with a main classification to rock, swing, reggae, etc. being done in the first stage, a timing classification to 8-beat, 16-beat, triplet, etc. being done in the second state and a classification to normal pattern, syncopation pattern, etc. being done in the third stage, so that the best rhythm pattern can be selected gradually.

As has been shown, with the above embodiment one of preset automatic accompaniment patterns is selected to automatically change automatic accompaniment patterns according to data indicative of the features of key depression state extracted according to a key depression timing or key depression speed in a predetermined period. Thus, there is no need of providing a number of rhythm selection switches. In addition, automatic accompaniment rhythms are switched automatically in response to a change of music being performed. Thus, it is possible to obtain a very natural accompaniment. Further, the mechanism and circuit construction involved are simple, and the performance can be simplified.

It is possible to apply the principles underlying the invention to the control of percussion instrument sound according to the speed of operation of performance keys. To this end it may be arranged to let percussion instrument sound be produced when the speed of operation of a performance key exceeds a predetermined speed. In this case, however, the percussion instrument sound may be produced for each key operation only when an intense part of music is being performed and no percussion instrument sound may be produced while a quiet part of music is performed.

It is desirous that the best accompaniment effect to the state of performance be produced for any part of music.

FIGS. 12 to 16 show an embodiment, which realizes the considerations that are taken into in connection with the above aspect.

Figure 12:
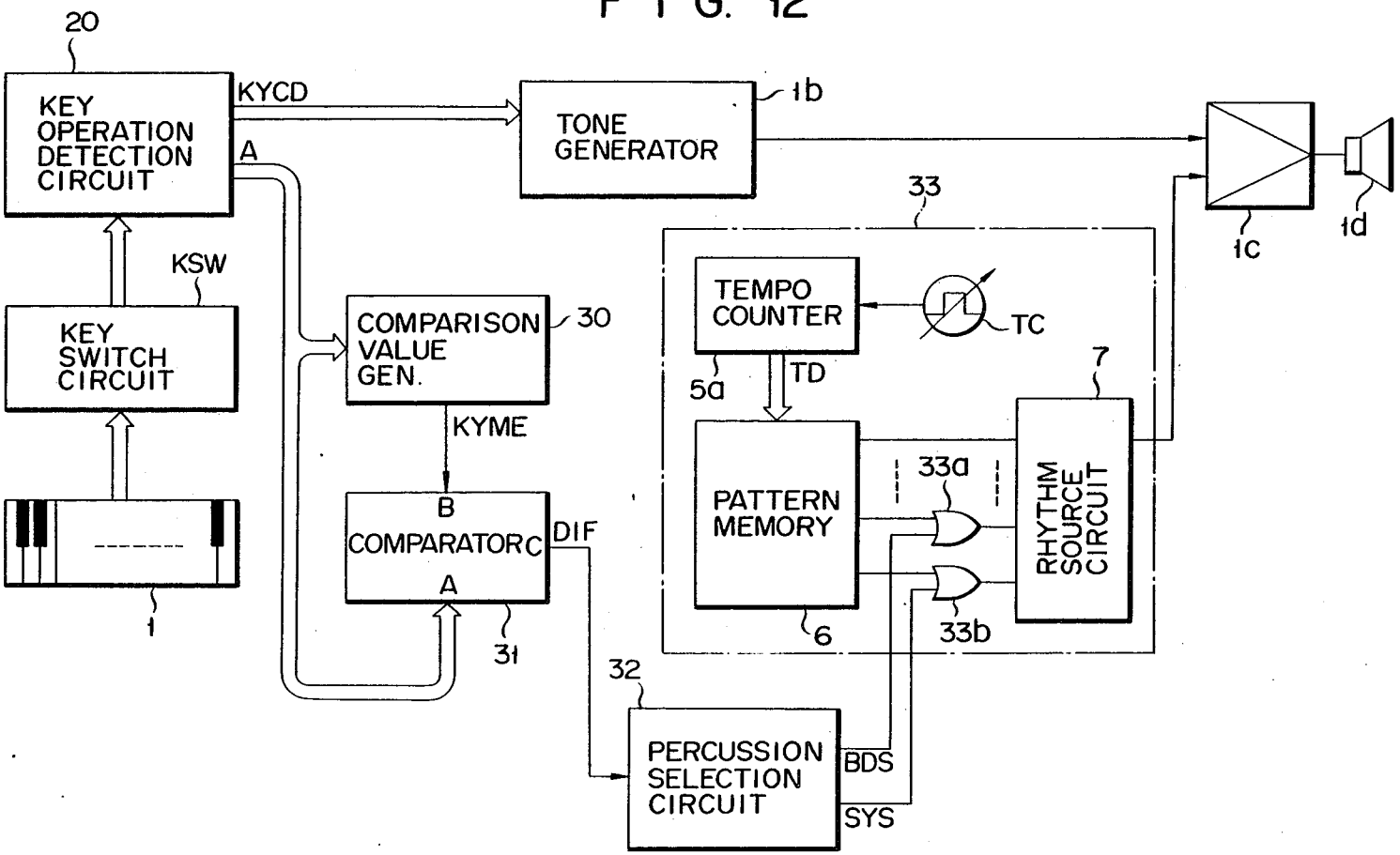
FIG. 12 is a block diagram showing a further embodiment of the invention.

Referring to FIG. 12, the key output of keyboard 1 is fed through a key switch circuit KSW to a key operation detection circuit 20. The key operation detection circuit 20 produces key code data KYCD to be supplied to tone generator 1*b* and key depression speed data A. The key depression speed data A is fed to a comparison value generator 30 and an A input terminal of a comparator 31.

The comparison value generator 30 produces comparison value data KYME for the prevailing key depression speed data A, for instance by taking the average of a series of key depression speed data A and feeds the data KYME to a B input terminal of the comparator 3. The comparator 31 compares the two inputs, i.e., key depression speed data A and comparison value data KYME and feeds difference data DIF from its output terminal C to a percussion selection circuit 32. The percussion selection circuit 32 produces a signal BDS for producing bass drum sound and also a signal SYS for producing cymbal sound according to the value of the difference data DIF. The signal BDS is fed to a rhythm source circuit 7 in an automatic rhythm generator 33 through an OR gate 33*a* while the signal SYS is fed to the circuit 7 through another OR gate 33*b*.

The automatic rhythm generator 33 includes a variable tempo oscillator TC, a tempo counter 5*a* for counting a tempo clock from the oscillator TC, a pattern memory 6 addressed by count output data TD from the tempo counter 5*a* for reading rhythm pattern data as parallel data, and the rhythm source circuit 7, which includes a plurality of percussion rhythm sources each corresponding to each bit of the rhythm pattern data. Of the rhythm pattern data, the bit BDS for the bass drum is fed to the rhythm source circuit 7 through the OR gate 33*a*, the the bit SYS for the cymbal is fed to the circuit 7 through the OR gate 33*b*. The rhythm source circuit 7 produces synthesized data, which is the resultant of the outputs of the individual rhythm sources, the synthesis data being fed through a sounding system comprising amplifier 1*c* and loudspeaker 1*d* to be sounded as rhythm.

Figure 13:
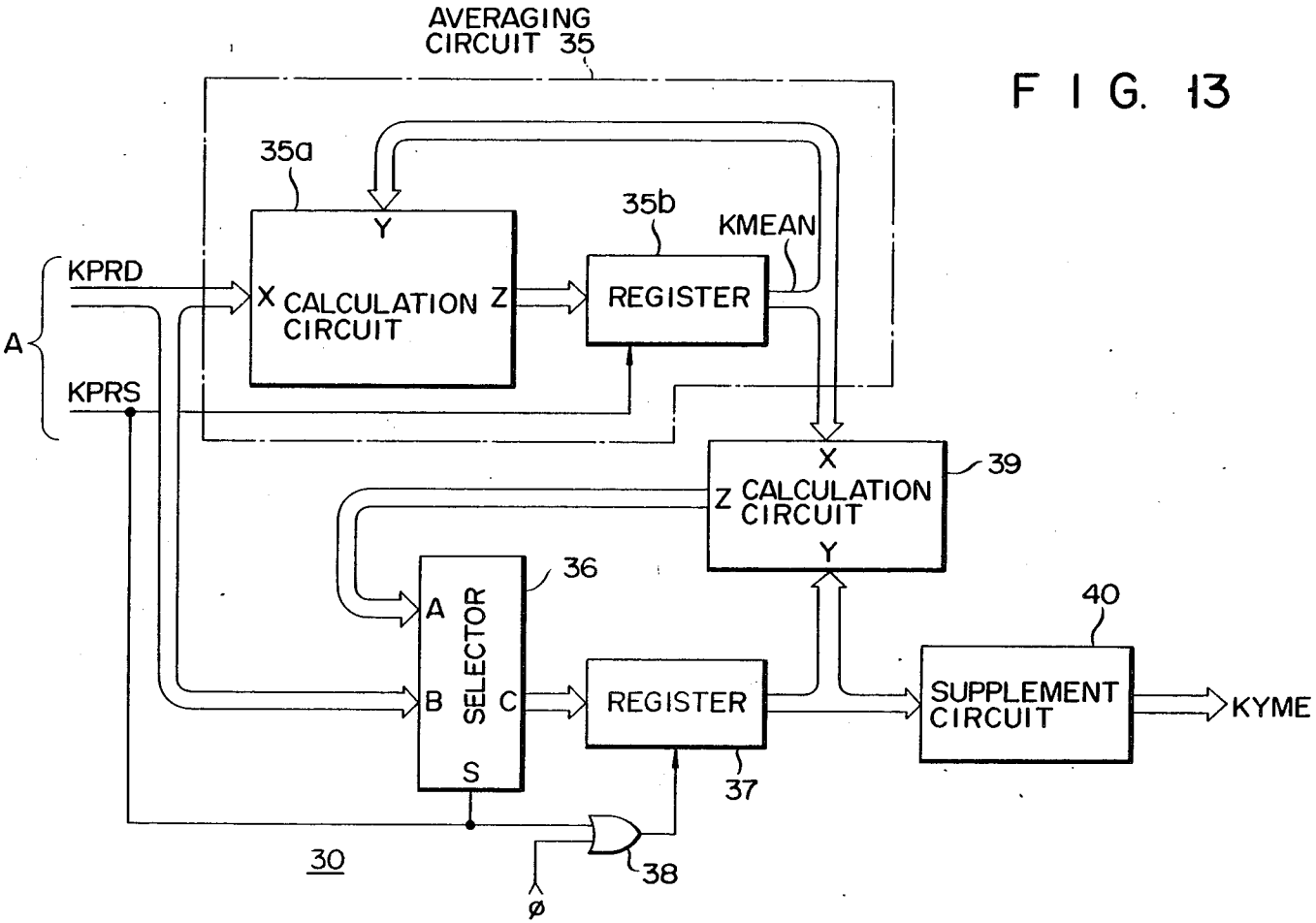
FIG. 13 is a block diagram showing a comparison value generator shown in FIG. 12.

FIG. 13 shows a specific circuit construction of the comparison value generator 30. The key depression speed data A consists of 8-bit data KPRD representing the actual key depression speed and one-bit data KPRS which is "1" in the presense of the key depression speed data A and "0" in the absence of the data A. The data KPRD is fed to an X input terminal of a calculation circuit 35*a* in a averaging circuit 35 and also to a B input terminal of a selector 36. The data KPRS is fed as drive signal to a register 35*b* in the averaging circuit 35, to an S input terminal of the selector 36 and to a register 37 through an OR gate 38.

In the register 35*b* is held previous average value data KMEAN which is fed to a Y input terminal of the calculation circuit 35*a*. The calculation circuit thus performs averaging calculation of $0.1X+0.9Y$ with the two inputs to obtain a new average value. The new average value is fed to the rigister 35*b* from a Z output terminal, when data KPRS of "1" is provided.

The average value data KMEAN is fed to an X input terminal of a calculation circuit 39. The calculation circuit 39 also performs averaging calculation of 0.1X 0.9Y with the inputs to its X and Y input terminals and feeds the result data from its Z output terminal to an A input terminal of the selector 36. When the data KPRS is "0", the selector 36 selects the result data input to the A input terminal and feeds it from its C output terminal to the register 37. When the data KPRS is "1", it selectively feeds the data KPRD fed to the B input terminal to the register 37. The register 37 fetches the data from the selector 36 under the control of the signal KPRS from the OR gate 38 or a clock $\phi$ provided at an interval of an eighth note and feeds it to the Y input terminal of the calculation circuit 39 and also to a supplement circuit 40.

The supplement circuit 40 performs adequate supplement with respect to the input data. For example, it effects supplement to a rather small extent when the absolute value of the input is small, while effecting supplement to a rather great extent when the absolute value is large. Its output is provided as the comparison value data KYME.

The operation of the embodiment will now be described with reference to the waveform diagrams of FIGS. 14 and 15. When a performance key on the keyboard 1 is operated, a corresponding key switch in the key switch circuit KSW is turned on and off, and the key operation detection circuit 20 thus produces key code data KYCD and key depression speed data A. The key code data KYCD is fed to the tone generator 1*b*, and the key depression speed data A is fed to the comparison value circuit 30 and to the A input terminal of the comparator 31.

Meanwhile, in the automatic rhythm generator 33, the tempo counter 5*a* counts the tempo clock output of the tempo oscillator TC to access the pattern memory 6 according to the count data TD so as to read out preset rhythm pattern data repeatedly for each measure, for instance, the read-out data being fed to the rhythm source circuit 7. The individual rhythm sources are thus driven by the input pattern data, and the resultant rhythm data is fed through the amplifier 1*c* to the loudspeaker 1*d* to be sounded as automatic accompaniment rhythm.

In the comparison value generator 30, the key depression speed data A is supplied as the 8-bit data KPRD representing the actual key depression speed and one-bit data KPRS indicative of whether there is any key depression. The data KPRD is fed to the X input terminal of the calculation circuit 35*a* and also to the B input terminal of the selector 36, while the signal KPRS is fed as drive signal to the register 35*b*, S input terminal of the selector 36 and register 37. Thus, when the data KPRS of "1" is supplied along with the data KPRD with actual depression of a key, the calculation circuit 35*a* executes the calculation of $0.1X+0.9Y$ with the data KPRD fed to the X input terminal and previous key depression speed average data KMEAN fed from the register 35*b* to the Y input terminal to obtain new average value data with respect to a series of key depression speed data KPRD, the new average value data being set in the register 35*b*. This average value data KMEAN subsequently prevails at the Y input terminal of the calculation circuit 35*a* and X input terminal of the calculation circuit 39 until the next key depression is detected.

When the signal KPRS becomes "1", the selector 36 selects the data KPRD at the B input terminal to be set in the register 37 and fed to the Y input terminal of the calculation circuit 39 and supplement circuit 40. At this time, the calculation circuit 39 executes the calculation of $0.1X+0.9Y$ with the new average value data KMEAN fed to the X input terminal and data KPRD fed to the Y input terminal, i.e., it obtains new average value data between the previous key depression speed average value data KMEAN and prevailing key depression speed data KPRD, the new average value data being fed to the A input terminal of the selector 36.

If no key is depressed for a period in excess of the interval of an eighth note, a pulse of clock which is provided at the interval of an eighth note, is impressed as drive signal on the register 37 via OR gate 38. At this time, the selector 36 fetches data fed to the A input terminal (because the signal KPRS is "0") and feeds it to the Y input terminal of the calculation circuit 39 and supplement circuit 40. The calculation circuit 39 thus executes the averaging calculation of $0.1X+0.9Y$ with the average value data KMEAN and the other average value data to obtain new average value data, which is fed to the A input terminal of the selector 36. The supplement circuit 40 executes a predetermined supplement with respect to the input data to obtain the comparison value data KYME fed to the B input terminal of the comparator 31.

Whenever a key is operated, the comparator 31 derives the difference between the data KPRD in the key depression speed data A fed to the A input terminal and comparison value data KYME fed to the B input terminal and feeds the difference data DIF to the percussion selection circuit 32. When the input difference data DIF is below a first level, the percussion selection circuit 32 provides both data BSD and SYS of "0" to the rhythm source circuit 7. In this case, neither bass drum sound nor cymbal sound is produced, i.e., no accent is given. This case occurs when the magnitude of the prevailing key depression speed is closest to the magnitude of the comparison value data KYME.

When the difference data DIF is between a second level, which is above the first level, and first level, the percussion selection circuit 32 provides data BDS of "0" and data SYS of "1" to the rhythm source circuit 7. Thus, cymbal sound is produced, i.e., a weakest accent is given to the performance.

When the difference data DIF is between a third level, which is above the second level, and second level, the percussion selection circuit 32 provides data BDS of "1" and data SYS of "0". Thus, bass drum sound is produced, i.e., a medium accent is given.

When the difference data DIF is above the third level, the percussion selection circuit 32 provides both data BDS and SYS of "1". In this case, both bass drum sound and cymbal sound are thus produced, i.e., a strongest accent is given.

Figure 14:
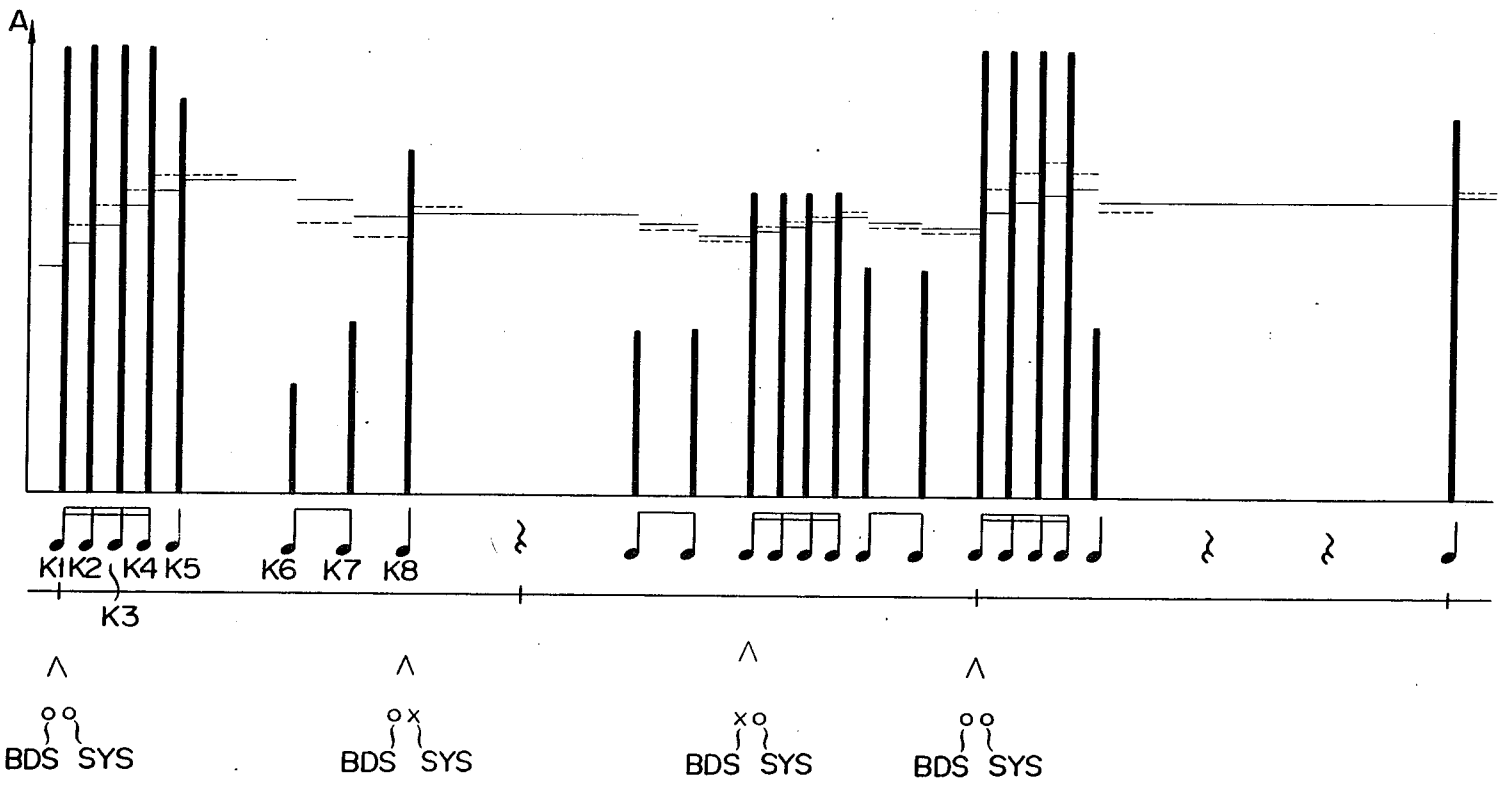
FIG. 14 is a view showing the state of accent attachment for an intense part of music.

FIG. 14 shows an example of accent attachment when music is performed at varying dynamic level. In the Figure, mark "A" represents the attachment of an accent, and symbols "o" and "x" represent "1" and "0", respectively. The vertical lines provided above the individual notes represent the key depression speed data A for these notes. Solid horizontal lines represent the average value data KMEAN, and dashed horizontal lines represent the average value data set in the register 37.

For the first tone K1 in the music (which is a first sixteenth note tone in a quadruplet), a preset value is set as the average value data KYME at the B input terminal of the comparator 31 for comparison with the key depression speed data KYPR at this time. Since at this time the difference value DIF is above the third level, both bass drum sound and cymbal sound are produced, i.e., the strongest accent is attached.

For the second to fourth tones K2 to K4 the key depression speed is the same as for the first tone K1, and also the key depression interval is shorter than the interval of an eighth note. Thus, the comparator 31 compares the key depression speeds for the first and second tones K1 and K2, those for the second and third tones K2 and K3 and those for the third and fourth tones K3 and K4 for the respective tones K2 to K4 (refer to the description of the function of the selector 36). For these tones, therefore, the difference data DIF is at zero level, i.e., no difference is produced, so that no accent is attached. During this time the averaging circuit 35 obtains successive new average value data KMEAN, while also the calculation circuit 39 also obtains successive new average value data, and the difference between the two data is successively reduced.

Subsequently, the key for the fifth tone K5 is depressed an interval of a sixteenth note after and at a lower speed level than the depression of the key for the fourth tone K4. At this time, no accent is of course attached for the depression speed is lower than the preceding one.

The key for the subsecuent sixth tone K6 is depressed an interval of a fourth note after and at a lower level than the depression of the key for the fifth tone K5. Of course no accent is attached at this time. One pulse of the clock $\phi$ is provided between the key depressions for the fifth and sixth tones K5 and K6. At this time, the average value data at the A input terminal of the selector 36 is fed as new average value data to the calculation circuit 39. As is shown, the value of this data is substantially equal to the previous average value data KMEAN. It will be seen that so long as there is no key depression interval longer than the eighth note interval, both the average value data approach each other, and hence the comparison value data KYME approaches the average value data KMEAN, so that depends on the average value rather than the previous key depression speed.

The state of accent attachment for the seventh tone K7 and following tones, is similar to that described above, so that it will not be described in detail.

Figure 15:
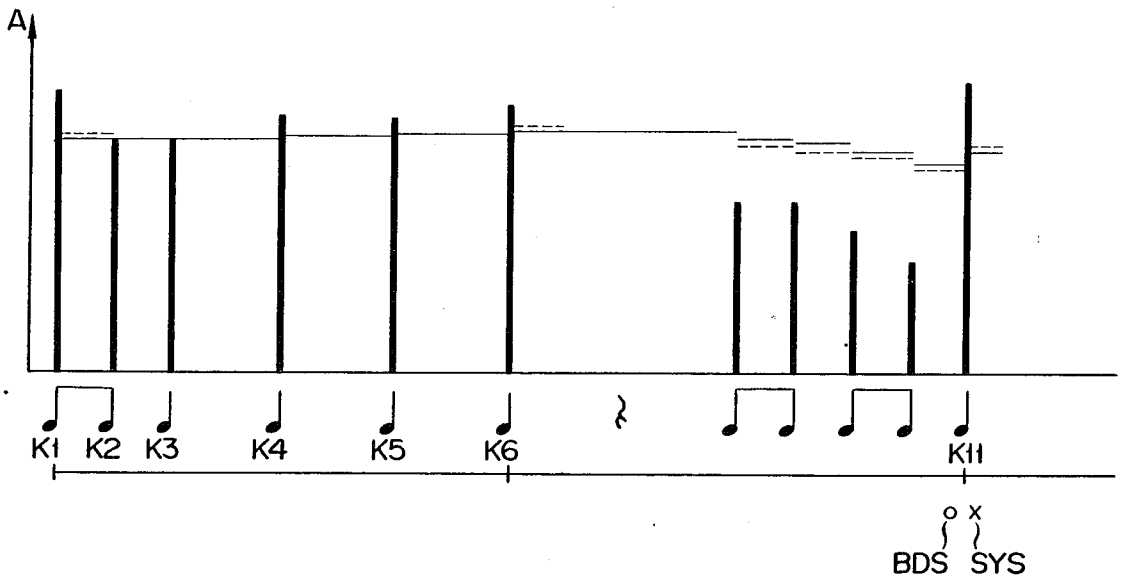
FIG. 15 is a view showing the state of accent attachment for a quiet part of music.

FIG. 15 shows an example of performance of music at a low dynamic level as a whole. In this case, the state of accent attachment is similar to the case of FIG. 14, so that it will not be described in detail.

Figure 16:
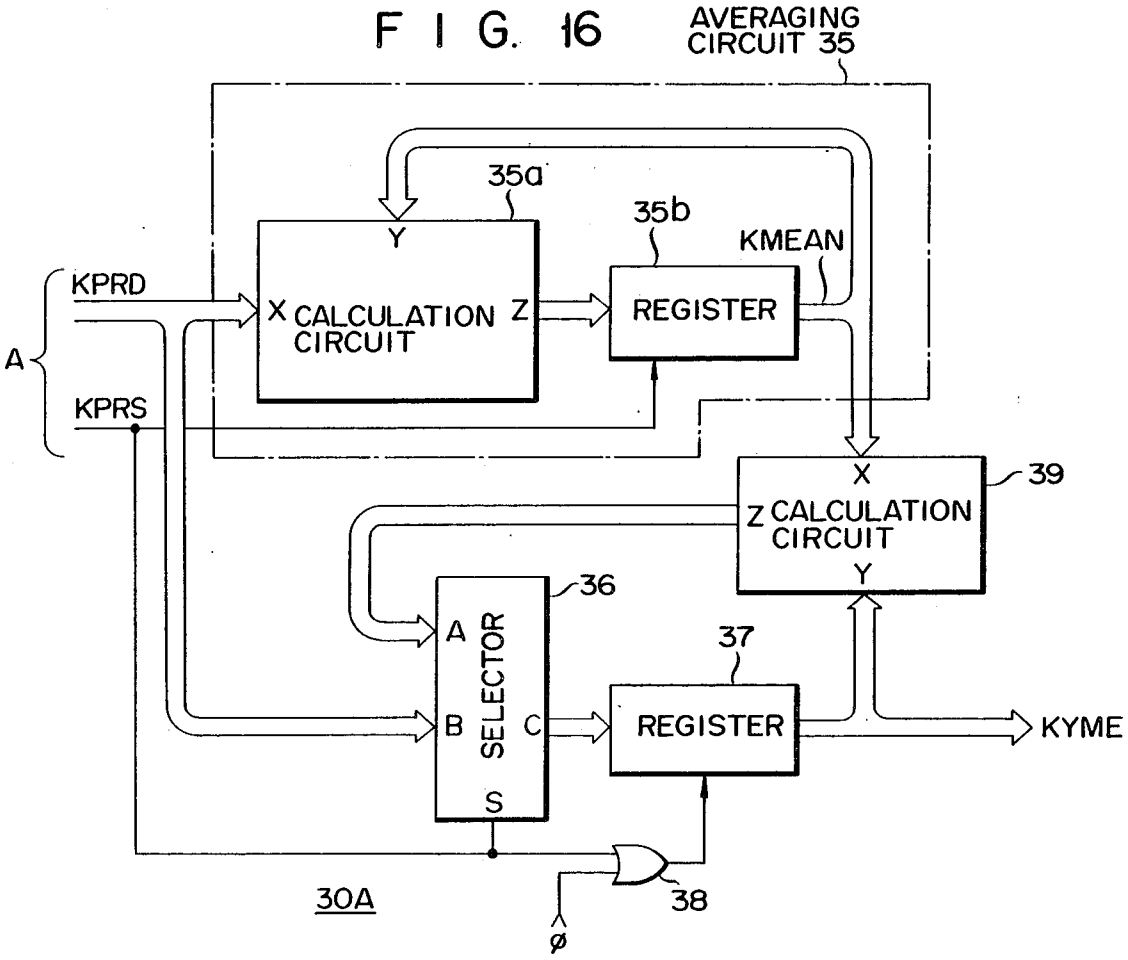
FIG. 16 is a block diagram showing a modification of the comparison value generator to be used in a still further embodiment.

FIG. 16 shows a modification of the comparison value generator. This modification 30A is obtained by omitting the supplement circuit 40 in the comparison value generator 30. With this circuit, substantially the same effects as in the embodiment of FIG. 12 can be obtained.

While the above embodiment has concerned with percussion sound as the effect sound, it may be replaced with any other kind of effect sound.

As has been shown, with the above embodiment the state of production of the effect sound is automatically controlled according to the key depression speed. Thus, adequate effect sound to the state of performance can be produced irrespective of whether the prevailing part of music is intense or quiet, so that it is possible to obtain an improved performance effect.

What is claimed is:

1. An electronic musical instrument comprising:
a keyboard having a plurality of performance keys;
means for producing a detection signal as a function of at least one of (i) the amount of pressure of depression and (ii) speed of depression of a performance key;
means for generating a plurality of preset automatic accompaniment pattern data;
means for changing automatic accompaniment pattern data as a function of said detection signal; and
means for providing automatic accompaniment tones as a function of changed automatic accompaniment pattern data.

2. The electronic musical instrument according to claim 1, wherein said changing means includes:
comparison value generator means;
means for comparing the comparison value output of said comparison value generator means and said detection signal;
means for providing an address change signal according to the result of comparison in said comparing means; and
an automatic accompaniment pattern memory in which a plurality of automatic accompaniment pattern data are sotred and which provides automatic accompaniment pattern data according to said address change signal.

3. The electronic musical instrument according to claim 1, wherein said means for generating a plurality of preset automatic accompaniment pattern data includes:
a memory with a plurality of automatic accompaniment pattern data stored therein;
tempo clock generator means for generating a tempo clock output;
a tempo counter for receiving the tempo clock output of said tempo clock generator means and supplying address designation data to said memory in accordance with the progress of tempo; and
means for selectively designating said automatic accompaniment pattern data stored in said memory.

4. The electronic musical instrument according to claim 2, wherein said selective control means further includes:
a measure counter with a predetermined number preset therein according to the output of said comparing means;
means for decrementing the count of said measure counter every time the performance of one measure is ended; and
means for removing said address change signal from said automatic accompaniment pattern memory when the count of said measure counter becomes zero.

5. An electronic musical instrument according to claim 2, wherein said comparison value generator means includes means for generating a comparison value with respect to a preceding key operation state from a plurality of series of detection signals from said detection signal producing means; and
said changing means further includes means for controlling generation of a prescribed effect tone in response to an output of said comparing means.

6. An electronic musical instrument according to claim 5, wherein said comparison value generating means includes means for calculating a mean value of said series of a plurality of key depression detection signals to obtain the comparison value.

7. An electronic musical instrument according to claim 5, wherein said comparison value generating means includes means for setting said preceding detection signal as a new comparison value when key depression interval is within a prescribed period of time, while and an interval of the key depression period is larger than a prescribed period of time, a mean value of a series of a plurality of key depression detection signals is used as a new comparison value.

8. An electronic musical instrument comprising:

means for producing a detection signal as a function of at least one of (i) pressure of depression and (ii) speed of depression of a performance key level detection means for detecting whther or not said detection signal is larger than a preset level;

means for changing a rhythm pattern as a function of a level detection signal produced from said level detection means; and means for generating rhythm sounds as a function of a changed rhythm pattern.

9. An electronic musical instrument according to claim 8, wherein said pattern changing means includes means for changing a rhythm pattern when it is detected that said detection signal becomes larger than the preset level and for restoring the changed pattern after a preset lapse of time.

10. An electronic musical instrument according to claim 8, wherein said level detection means includes means for executing a predetermined calculation upon a current detection level and the preset level, and for setting a result of the calculation as an updated new preset level.

11. An electronic musical instrument according to claim 10, wherein said level detection means further includes means for detecting whether or not said detection level is larger than a fixed level.

12. An electronic musical instrument comprising:

means for extracting feature data representing a feature of a key operation state as a function of a key operation done within a preset period of time, said feature data extracting means including means for geneating a plurality of timing data within a period of a measure in a piece of music being played, means ofr storing key depression data each time said timing data is generated, means for obtaining the total number of key depressions in said measure, and means for dividing key depression data stored at each time said timing data is generated by the total number of said key depressions to generate a series of feature data each time said timing data is generated;

pattern selection means for selecting an appropriate accompaniment patterm from preset accompaniment patterns as a function of said feature data extracted by said feature extracting means; and means for generating an accompaniment sound with an accompaniment pattern selected by said pattern selection means.

13. An electronic musical instrument according to claim 12, wherein said pattern selection means includes;

means for storing a plurality of series of preset reference feature data;

a pattern classification circuit for obtaining a similarity between said series of preset reference feature data and said detected seies of feature data; and an accompnaiment pattern data memory means to which an output of said pattern classification circuit is supplied as address designation data.

* * * * *